US006672675B1

(12) United States Patent
Swain

(10) Patent No.: US 6,672,675 B1
(45) Date of Patent: Jan. 6, 2004

(54) TRAVERSE CARRIAGE

(76) Inventor: Jon M. Swain, 3145 Holloway Rd., Ruston, LA (US) 71270

( * ) Notice: Subject to any disclaimer, the term of this patent is extended or adjusted under 35 U.S.C. 154(b) by 37 days.

(21) Appl. No.: 10/155,388

(22) Filed: May 28, 2002

(51) Int. Cl.[7] ..... E21C 25/00; E01C 19/00
(52) U.S. Cl. ..... 299/36.1; 299/75; 404/83
(58) Field of Search ..... 299/39.5, 36.1, 299/73, 75; 404/83

(56) References Cited

U.S. PATENT DOCUMENTS 4,433,871 A * 2/1984 Bertrand ..... 299/75
4,792,190 A * 12/1988 Bertrand ..... 299/75
4,832,412 A * 5/1989 Bertrand ..... 299/75
4,878,713 A * 11/1989 Zanetis ..... 299/39.5
5,230,270 A * 7/1993 Bertrand ..... 83/489
5,378,080 A * 1/1995 Dickson ..... 299/39.5
5,779,524 A * 7/1998 Swain ..... 451/102
6,158,817 A * 12/2000 Bertrand ..... 299/75
6,286,905 B1 * 9/2001 Kimura et al. ..... 299/73

* cited by examiner

*Primary Examiner*—David Bagnell
*Assistant Examiner*—Brian Halford
(74) *Attorney, Agent, or Firm*—John M. Harrison

(57) ABSTRACT

A traverse carriage and operator arrangement for transversely adjusting the abrader unit or units of a mobile surface abrading apparatus. In a preferred embodiment the traverse carriage is mounted on a cross-member by means of rollers and is operated by a specially designed, fluid-operated cylinder horizontally oriented in the mobile surface abrading apparatus and attached to the traverse carriage and the apparatus frame for moving the traverse carriage along the cross-member and positioning the abrader unit a selected distance along the cross-member transverse to the longitudinal movement of the mobile surface abrading apparatus.

12 Claims, 3 Drawing Sheets

TRAVERSE CARRIAGE

BACKGROUND OF THE INVENTION

1. Field of the Invention

Various types of mobile surface abrading apparatus are known in the art. These apparatus are typically characterized by vehicles of specific design carrying one or more abrader units designed to impinge an abrasive material against the surface as the vehicles move over the surface to modify the surface for cleaning, surface preparation, or to provide better traction for rubber tire vehicle traffic. One of the functions of these devices is the requirement for making multiple passes over the surface in order to treat the surface in one or more overlapping passes, which must join each other precisely to provide an evenly abraded surface.

The traverse carriage and operator or positioning device of this invention are designed to precisely adjust one or more abrader units transversely to the longitudinal axis of a mobile surface abrading apparatus to facilitate a more accurate overlap and a broader multiple pass operation and accompanying increased operating efficiency, which translates into reduced operating expense. The traverse carriage and operator include a traverse carriage or weldment movably mounted by means of a sliding device or rollers transversely on a cross-member such as an I-beam, fixed to the vehicle chassis and positioned by a cylinder or actuator device attached between the vehicle and the carriage for moving the carriage from side-to-side in selected increments to achieve optimum efficiency in swath overlap and width enhancement of the underlying surface to be treated.

2. Description of the Prior Art

Several United States patents describe typical mobile surface abrading apparatus having adjustable abrader units. Most of the units described in these patents have the abrader unit (or blast head) rigidly mounted to the vehicle chassis and do not allow vertical movement of the abrader unit or horizontal or transverse abrader movement. These devices use resilient, (typically rubber) seals between the blast head and the surface to prevent the escape of abrasive. These seals are supposed to correct surface unevenness.

It is an object of this invention to provide a new and improved traverse carriage and positioning operator for moving a carriage or weldment transversely to the longitudinal movement (or travel) of a mobile surface abrading carrying vehicle, to position one or more abrader units attached to the carriage in a selected path of abrasion over a surface to be treated.

Another object of this invention is to provide a traverse carriage and operator or positioning device for suspending one or more abrader units in a precise location over a surface to be textured or treated and transversely operating the abrader unit to cover a desired swath or treatment path relatively parallel to, but not necessarily centered with, the path of the host vehicle.

SUMMARY OF THE INVENTION

These and other objects of the invention are provided in a traverse carriage and operator for suspending one or more abrader units in a mobile surface abrading vehicle or apparatus over a surface to be treated, which traverse carriage includes a weldment movably mounted by means of a friction-reducing sliding device or rollers on a cross-member (typically an I-beam) fixed to the carrying vehicle or apparatus and designed to transversely traverse the cross-member in selected increments responsive to operation of a positioning device or operator to precisely position the abrader unit or units carried by the weldment over a selected area of the surface during operation of the mobile surface abrading unit or apparatus.

BRIEF DESCRIPTION OF THE DRAWINGS

The invention will be better understood by reference to the accompanying drawings, wherein.

DESCRIPTION OF THE PREFERRED EMBODIMENTS

Figure 1:
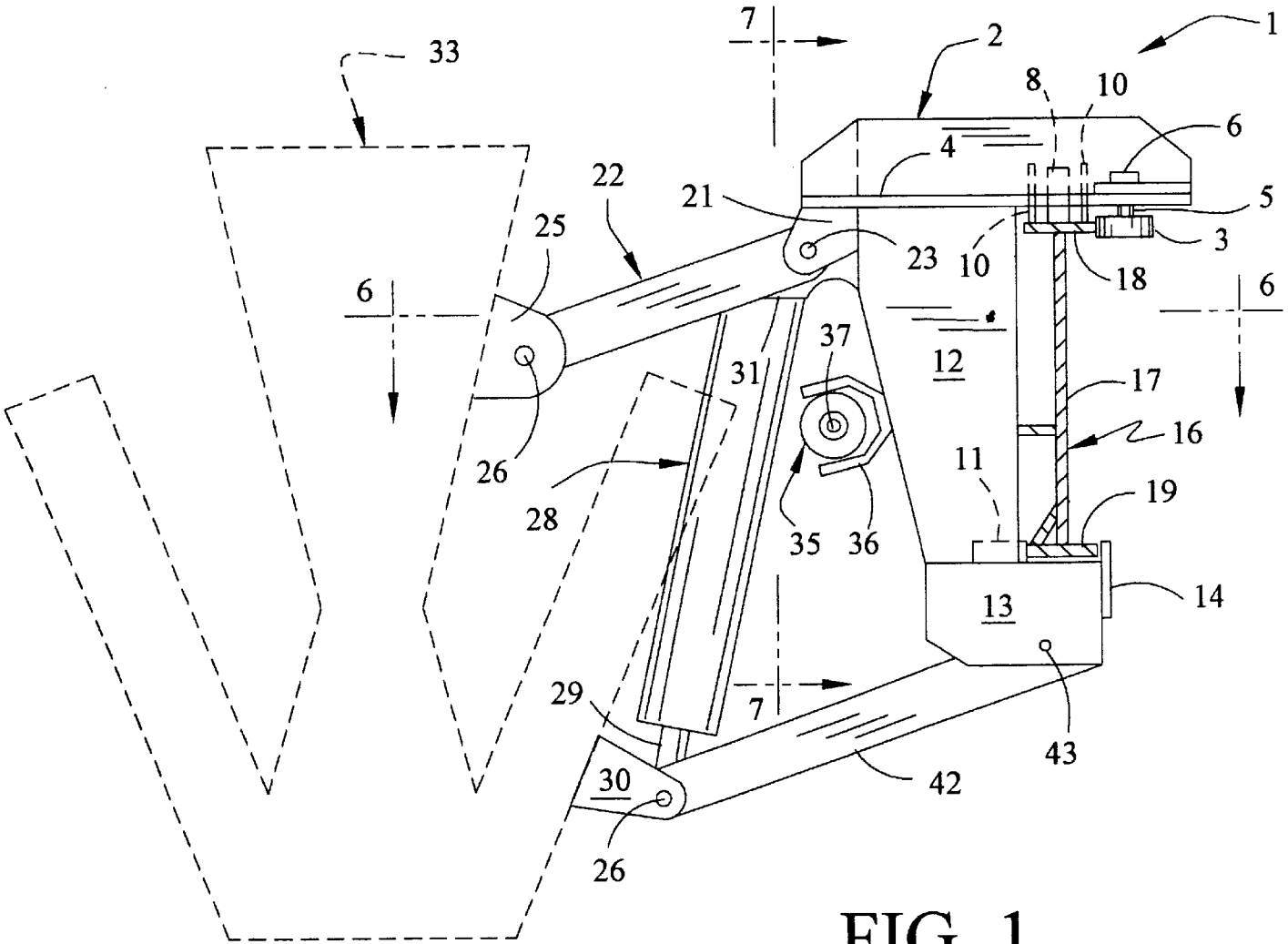
FIG. 1 is a side view of a preferred embodiment of a preferred traverse carriage and operator cylinder of this invention, carrying an abrader unit.
Figure 2:
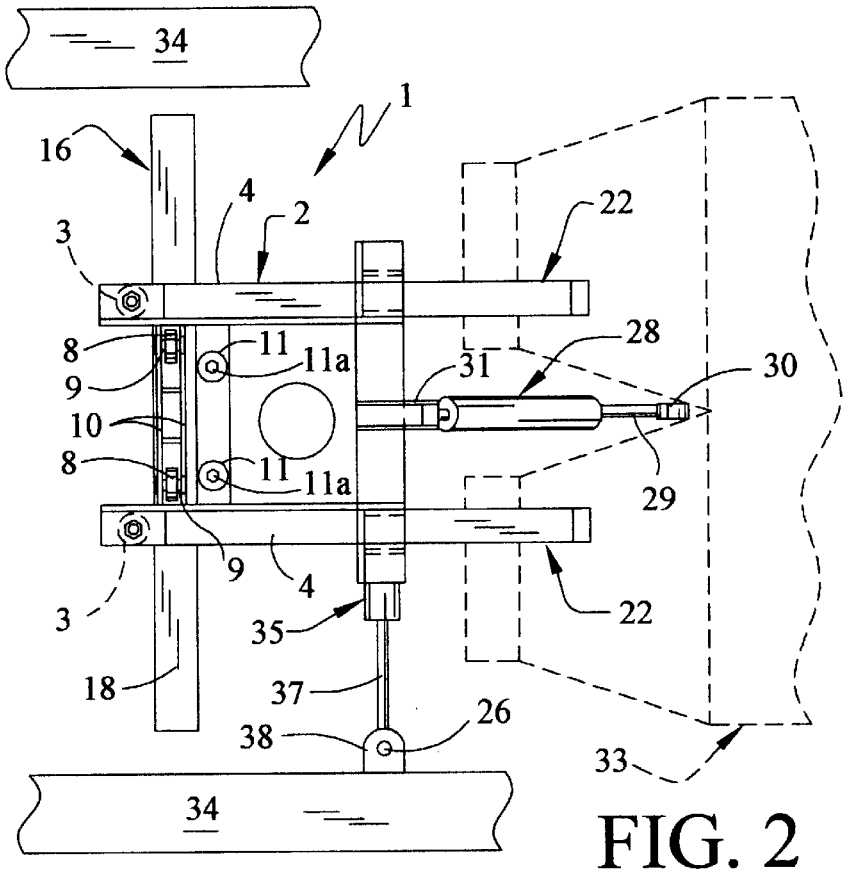
FIG. 2 is a top view of the traverse carriage and operator cylinder.
Figure 3:
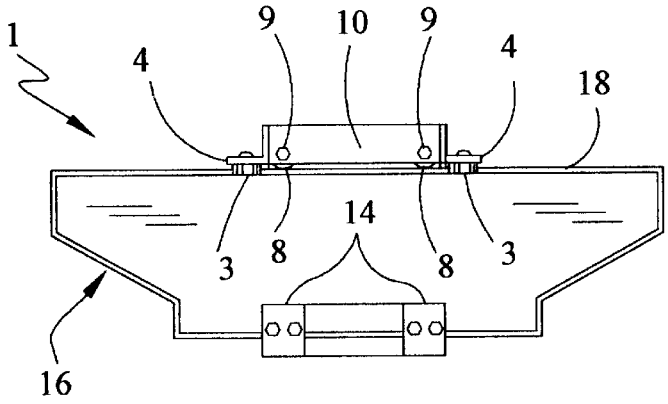
FIG. 3 is an end view of the traverse carriage and operator cylinder illustrated in FIGS. 1 and 2.
Figure 4:
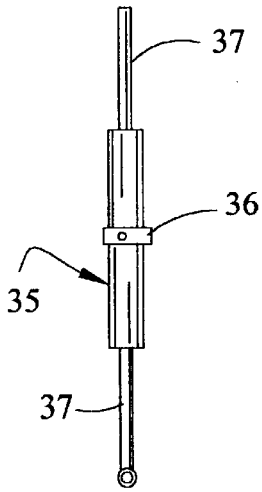
FIG. 4 is a top view of a typical double-action fluid operator cylinder designed for attachment to the traverse carriage and the mobile surface abrading apparatus frame and transversely operating and adjusting the traverse carriage with respect to the longitudinal axis of the mobile surface abrading apparatus.

Referring now to FIGS. 1–3 of the drawings, a traverse carriage for mounting on a typical mobile surface abrading apparatus (not illustrated), is indicated by reference numeral 1. The traverse carriage 1 is typically characterized by a weldment 2, fitted with a pair of spaced-apart upper horizontal rollers 3, each rotatably mounted on an upper horizontal roller flange 4 by means of corresponding upper horizontal roller mount shafts 5, which are each seated and tightened by a shaft nut 6. Two spaced-apart top vertical rollers 8 are vertically oriented in spaced-apart relationship on respective top vehicle roller mount shafts 9, attached to top vehicle roller mount plates 10, that are secured to the top of the weldment 2. A pair of spaced-apart lower horizontal rollers 11 are horizontally mounted on corresponding lower roller mount pins 11*a*, also mounted on the weldment 2. The weldment body 12 includes a weldment foot 13 on each end thereof, to which are attached a stay plate 14 and a pair of spaced-apart lower connecting arms 42, pivoted in place by means of foot pins 43. The opposite ends of the pivotally-mounted lower connecting arms 42 are each pivotally attached to a corresponding lower abrader unit bracket 30 of an abrader unit 33, (illustrated in phantom) by means of a mount pin 26, as further illustrated in FIG. 1. The weldment 2 is pivotally connected to the abrader unit 33 by means of a pair of spaced-apart upper connecting arms 22, each of which is attached to the upper segment of the weldment 2 by means of corresponding upper forward connecting brackets 21 and upper forward arm mount pins 23. The opposite ends of each of the upper connecting arms 22 are also pivotally secured to the abrader unit 33 by means of mount pins 26, extending through corresponding upper abrader unit brackets 25. Accordingly, it will be appreciated from a consideration of FIG. 1 that the abrader unit 33 is allowed to articulate vertically with respect to the transversely-operated weldment 2 by operation of the upper connecting arms 22 and the lower connecting arms 42.

As further illustrated in FIGS. 1 and 2, this vertical articulation of the abrader unit 33 is facilitated by operation of a lift cylinder 28, secured at one end thereof to an upper lift cylinder bracket 31. The lift cylinder piston rod 29 of the lift cylinder 28 is attached at the free end to a corresponding bracket (not illustrated) mounted on the abrader unit 33, to facilitate raising and lowering the abrader unit 33 by extension and retraction of the lift cylinder piston rod 29 and articulation of the upper connecting arms 22 and the lower connecting arms 42.

Referring again to FIGS. 1 and 2 of the drawings, a cross-member 16 is fixed between opposite sides of the vehicle frame 34, illustrated in FIG. 2, and includes a web 17 with a top flange 18 and a bottom flange 19 terminating the top and bottom of the web 17, as illustrated. The upper horizontal rollers 3 are designed to traverse the front edge of the top flange 18 of the cross-member 16, while the top vertical rollers 8 simultaneously traverse the flat top of the top flange 18 of the cross-member 16, as further illustrated in FIGS. 1 and 2. Furthermore, at the same time, the lower horizontal rollers 11 engage and traverse the rear edge of the bottom flange 19 of the cross-member 16. Accordingly, the upper horizontal rollers 3, top vertical rollers 8 and lower horizontal rollers 11 serve to stabilize the weldment 2 as the weldment 2 traverses the cross-member 16 in a controlled manner, as hereinafter described.

Figure 8:
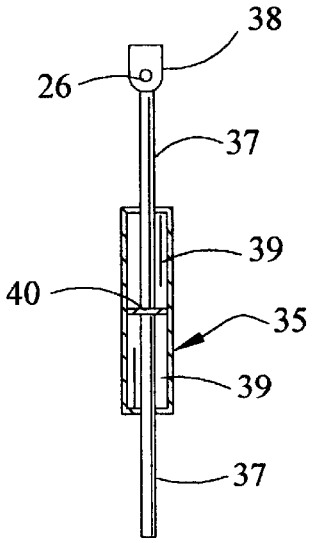
FIG. 8 is a longitudinal sectional view of the traverse carriage double-action fluid operator cylinder for operating the traverse carriage of this invention in a preferred embodiment.

Controlled traversal of the weldment 2 on the cross-member 16 is typically effected by means of a carriage travel cylinder 35 mounted in a carriage travel cylinder bracket 36, typically welded to, and extending from the weldment body 12, as further illustrated in FIG. 1. Referring to FIGS. 1, 2, 4, 6 and 8 of the drawings, the carriage travel cylinder 35 is preferably characterized by an in-line carriage travel cylinder rod 37, that extends from each end of the carriage travel cylinder 35, respectively, and is joined internally of the carriage travel cylinder 35 to a piston disc 40, defining a pair of cylinder chambers 39, as illustrated in FIG. 8. One end of the carriage travel cylinder piston 37 is attached to one side of the vehicle frame 34, typically by means of a bracket 38, while the opposite end of the carriage travel cylinder rod 37 is unattached. Consequently, fluid pressure applied in sequence to the carriage travel cylinder 35 in the cylinder chambers 39 on either side of the piston 40, causes the piston 40 to traverse the cylinder chambers 39 of the carriage travel cylinder 35 and thus move the weldment 2 equally in either direction on the cross-member 16, within the length of operation or "stroke", of the carriage travel cylinder 35.

Figure 5:
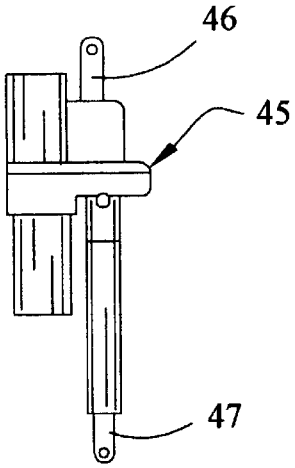
FIG. 5 is a front view of a typical actuator which may be substituted for the fluid cylinder operator illustrated in FIGS. 1 and 2.
Figure 6:
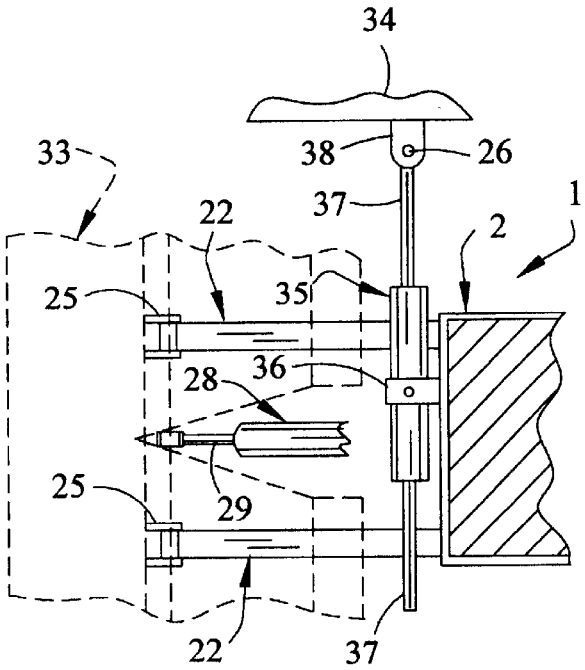
FIG. 6 is a sectional view taken along line 6—6 of the traverse carriage and operator cylinder illustrated in FIG. 1.
Figure 7:
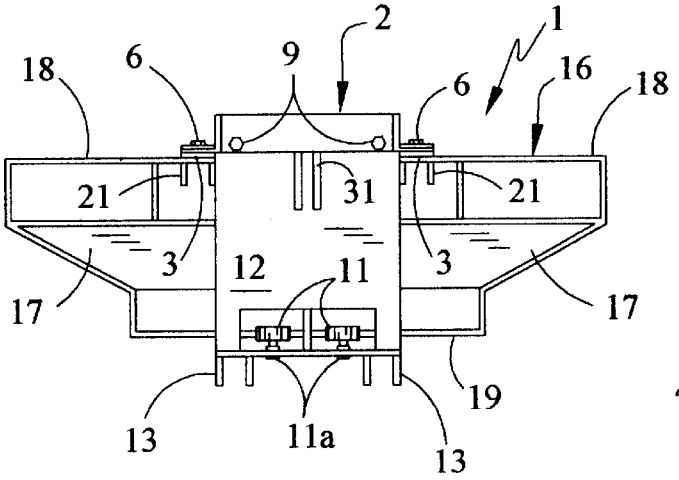
FIG. 7 is a sectional view taken along line 7—7 of the traverse carriage and operator cylinder illustrated in FIG. 1 with the carriage travel cylinder removed for brevity.

Alternatively, referring to FIG. 5 of the drawings, an actuator 45 can be substituted for the carriage travel cylinder 35, typically with the actuator base 46 secured to the vehicle frame 34 by means of a cylinder bracket 38, for example, and the jacking rod 47 of the actuator 45 mounted on the bracket 36, as illustrated with respect to the carriage travel cylinder 35 in FIG. 8.

It will be appreciated by those skilled in the art from a consideration of the drawings that both the carriage travel cylinder 35 and an actuator 45 may be used interchangeably in order to move the weldment 2 from side-to-side transversely between the respective vehicle frame elements 34, to control the swath or area of treatment of the abrader unit 33. Appropriate fluid such as air and hydraulic fluid can be used to operate the carriage travel cylinder 35 and electric current can be used to operate the actuator 45 and various controls, fluid cylinder hoses, valves, wires and switches and other apparatus necessary for controlling the carriage travel cylinder 35 and the actuator 45 can be implemented to selectively move the weldment 2 on the cross-member 16, according to the knowledge of those skilled in the art. Furthermore, the size and speed of the carriage travel cylinder 35 or the actuator 45 may be chosen to accord with the weight and operating requirements of the weldment 2 and the accompanying abrader unit 33 and facilitate movement of the weldment 2 in a transverse direction along the cross-member 16 with the necessary speed and incremental accuracy to achieve the desired adjoining abraded surface overlap beneath the abrader unit 33.

While the preferred embodiments of the invention have been described above, it will be recognized and understood that all modifications may be made in the invention and the appended claims are intended to cover all such modifications that may fall within the spirit and scope of the invention.

Having described my invention with the particularity set forth above, what is claimed is:

1. A traverse carriage in a mobile surface abrading apparatus for locating an abrader unit in a selected location over a surface, said traverse carriage comprising cross-member provided in the mobile surface abrading apparatus, said cross-member oriented substantially transverse to the direction of motion of the mobile surface abrading apparatus; a carriage movably mounted on said cross-member, said carriage carrying the abrader unit; a first pair of spaced-apart, horizontally-oriented rollers engaging the top of said cross-member; a second pair of spaced-apart, vertically-oriented rollers engaging the top of said cross member and a second pair of spaced-apart, horizontally-oriented rollers engaging the bottom of said cross-member for stabilizing said carriage on said cross-member; and a positioning mechanism connected to the mobile surface abrading apparatus and said carriage for selectively moving said carriage on said carriage support.

2. The traverse carriage of claim 1 wherein said positioning mechanism comprises a fluid-operated cylinder.

3. The traverse carriage of claim 1 wherein said positioning mechanism comprises an actuator.

4. A traverse carriage in a mobile surface abrading apparatus for locating an abrader unit in a selected location over a road, said traverse carriage comprising a carriage support cross-member fixedly mounted in the mobile surface abrading apparatus, said carriage support cross-member oriented substantially transverse to the direction of motion of the mobile surface abrading apparatus; a carriage positioned adjacent to said carriage support cross-member, said carriage carrying the abrader unit; three sets of rollers carried by said carriage for engaging said carriage support cross-member and stabilizing said carriage on said carriage support cross-member; and a positioning mechanism connected to the mobile surface abrading apparatus and said carriage for selectively moving said carriage with respect to said carriage support on said rollers, responsive to traversal of said carriage support cross-member by said rollers.

5. The traverse carriage of claim 4 wherein said positioning mechanism comprise the fluid-operated cylinder.

6. The traverse carriage of claim 4 wherein said positioning mechanism comprise an actuator.

7. The traverse carriage of claim 4 wherein said rollers comprise a first pair of spaced-apart, horizontally-oriented rollers engaging the top of said cross-member; a pair of spaced-apart, vertically-oriented rollers engaging the top of said cross-member; and a second pair of spaced-apart, horizontally-oriented rollers engaging the bottom of said cross-member for stabilizing said carriage on said cross-member.

8. The traverse carriage of claim 7 wherein said operating mechanism comprise a fluid-operated cylinder.

9. The traverse carriage of claim 7 wherein said operating mechanism comprise an actuator.

10. A traverse carriage in a mobile surface abrading apparatus for locating an abrader unit in a selected location over a road, said traverse carriage comprising a cross-member fixedly mounted in the mobile surface abrading apparatus, said cross-member oriented substantially transverse to the direction of motion of the mobile surface abrading apparatus; a carriage positioned adjacent to said cross-member, said carriage carrying the abrader unit; a first pair of spaced-apart, horizontally-oriented rollers engaging the top of said cross-member; a pair of spaced-apart, vertically-oriented rollers engaging the top of said cross-member; and a second pair of spaced-apart, horizontally-oriented rollers engaging the bottom of said cross-member for stabilizing said carriage on said cross-member; and an operating mechanism connected to the mobile surface abrading apparatus and said carriage for selectively moving said carriage with respect to said carriage support responsive to traversal of said carriage support by said rollers.

11. The traverse carriage of claim 10 wherein said operating mechanism comprises a fluid-operated cylinder.

12. The traverse carriage of claim 10 wherein said operating mechanism comprise an actuator.

* * * * *